US007584528B2

(12) United States Patent
Hu

(10) Patent No.: US 7,584,528 B2
(45) Date of Patent: Sep. 8, 2009

(54) SHOELACE REEL OPERATED EASILY AND CONVENIENTLY

(75) Inventor: Jung-Fu Hu, Taichung County (TW)

(73) Assignee: Meng Hann Plastic Co., Ltd., Taichung County (TW)

( * ) Notice: Subject to any disclaimer, the term of this patent is extended or adjusted under 35 U.S.C. 154(b) by 376 days.

(21) Appl. No.: 11/708,519

(22) Filed: Feb. 20, 2007

(65) Prior Publication Data

US 2008/0196224 A1 Aug. 21, 2008

(51) Int. Cl.
*A43C 11/20* (2006.01)
*A43B 5/04* (2006.01)

(52) U.S. Cl. ..... 24/68 SK; 24/712.9; 36/118.1

(58) Field of Classification Search ..... 24/712.1, 24/712.2, 712.5, 712.6, 712.9, 68 SK, 68 C, 24/68 D; 36/118.1, 50.5; 242/388.1
See application file for complete search history.

(56) References Cited

U.S. PATENT DOCUMENTS 4,433,456 A * 2/1984 Baggio ..... 24/68 SK
4,633,599 A * 1/1987 Morell et al. ..... 242/388.1
5,042,177 A * 8/1991 Schoch ..... 36/50.5
5,606,778 A * 3/1997 Jungkind ..... 24/68 SK
7,076,843 B2 * 7/2006 Sakabayashi ..... 24/68 SK
7,367,522 B2 * 5/2008 Chen ..... 242/378.1

* cited by examiner

*Primary Examiner*—Robert J Sandy
(74) *Attorney, Agent, or Firm*—Alan Kamrath; Kamrath & Associates PA

(57) ABSTRACT

A shoelace reel includes a support seat, a spool rotatably mounted in the support seat, a shoelace having two distal ends each secured to the winding zone of the spool, a limit sleeve mounted on the support seat, a drive member rotatably and movably mounted in the limit sleeve, and a control knob rotatably and movably mounted on the limit sleeve and connected to the drive member. Thus, the user only needs to rotate the control knob to tighten the shoelace and to pull out the control knob to loosen the shoelace. In addition, the user only needs to operate the control knob to tighten or loosen the shoelace, so that the user can tighten or loosen the shoelace by his one hand only.

20 Claims, 12 Drawing Sheets

SHOELACE REEL OPERATED EASILY AND CONVENIENTLY

BACKGROUND OF THE INVENTION

1. Field of the Invention

The present invention relates to a shoelace reel and, more particularly, to a shoelace reel for tightening or loosening a shoelace.

2. Description of the Related Art

A shoelace is mounted on a shoe so as to tighten or loosen the shoe. However, the user has to stretch the shoelace so as to tighten the shoe and to release the shoelace so as to loosen the shoe, thereby causing inconvenience to the user and wasting the user's time when tightening or loosening the shoelace. In addition, the shoelace protrudes from the shoe, thereby decreasing the aesthetic quality of the shoe.

BRIEF SUMMARY OF THE INVENTION

In accordance with the present invention, there is provided a shoelace reel, comprising a support seat having a first side formed with an axially extending receiving hole and a periphery formed with two spaced guide holes each connected to the receiving hole, a spool rotatably mounted in the receiving hole of the support seat and having a periphery formed with a winding zone and a first end formed with an inner gear, a shoelace having two distal ends each extended through a respective guide hole into the receiving hole of the support seat and each secured to the winding zone of the spool to move with the winding zone of the spool, a limit sleeve mounted on a second side of the support seat and having an inner wall formed with an axially extending limit hole and a plurality of oneway ratchet teeth, and a drive member rotatably and movably mounted in the limit hole of the limit sleeve and having a first end formed with an outer gear detachably meshing with the inner gear of the spool to rotate the spool, a mediate portion formed with a ratchet wheel meshing with the oneway ratchet teeth of the limit sleeve and a second end formed with a drive shaft protruded from the limit sleeve.

The primary objective of the present invention is to provide a shoelace reel that is operated easily and conveniently.

Another objective of the present invention is to provide a shoelace reel, wherein the user only needs to rotate the control knob to tighten the shoelace and to pull out the control knob to loosen the shoelace, so that the shoelace is tightened and loosened easily and quickly.

A further objective of the present invention is to provide a shoelace reel, wherein the user only needs to operate the control knob to tighten or loosen the shoelace, so that the user can tighten or loosen the shoelace by his one hand only, thereby facilitating the user tightening or loosening the shoelace.

A further objective of the present invention is to provide a shoelace reel, wherein the ratchet wheel of the drive member is limited by the oneway ratchet teeth of the limit sleeve so that the drive member is rotatable in a oneway manner to prevent the drive member from being rotated in the reverse direction and to prevent the shoelace from being loosened.

A further objective of the present invention is to provide a shoelace reel, wherein the shoelace is wound around and hidden in the winding zone of the spool to prevent the shoelace from being worn out due to friction, thereby enhancing the lifetime of the shoelace.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
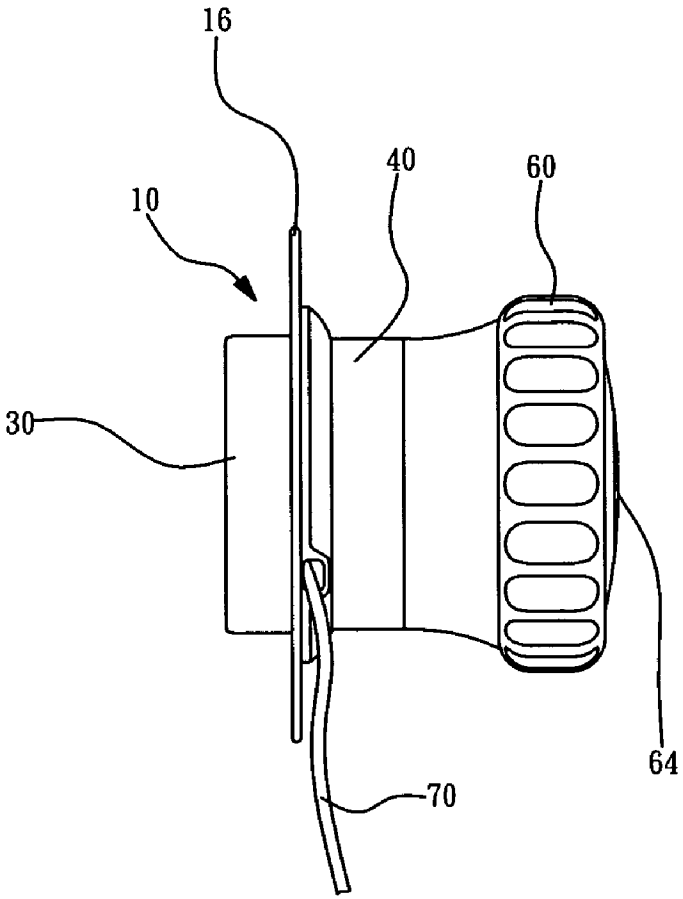
FIG. 1 is a side view of a shoelace reel in accordance with the preferred embodiment of the present invention.
Figure 2:
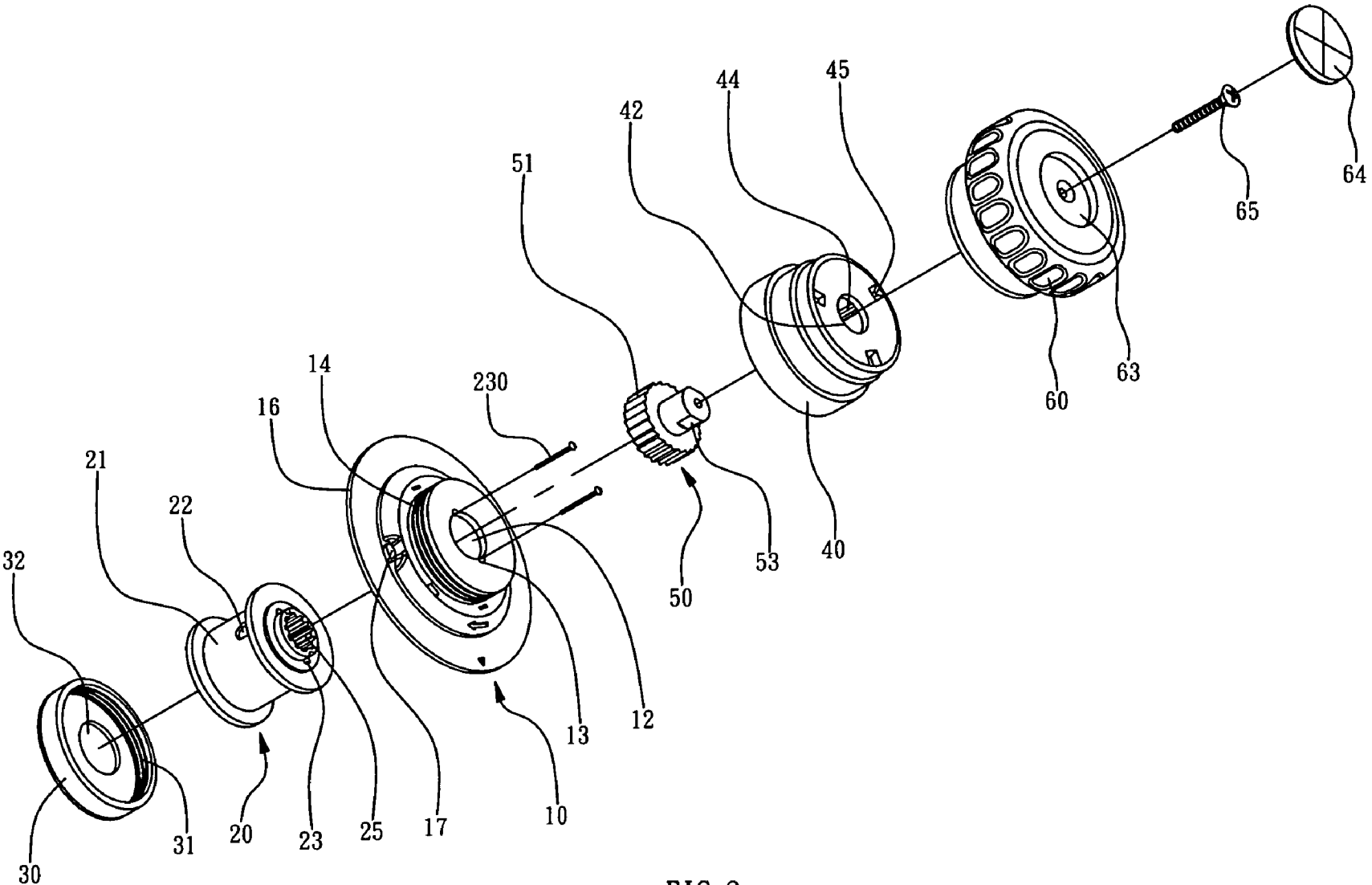
FIG. 2 is an exploded perspective view of the shoelace reel as shown in FIG. 1.
Figure 3:
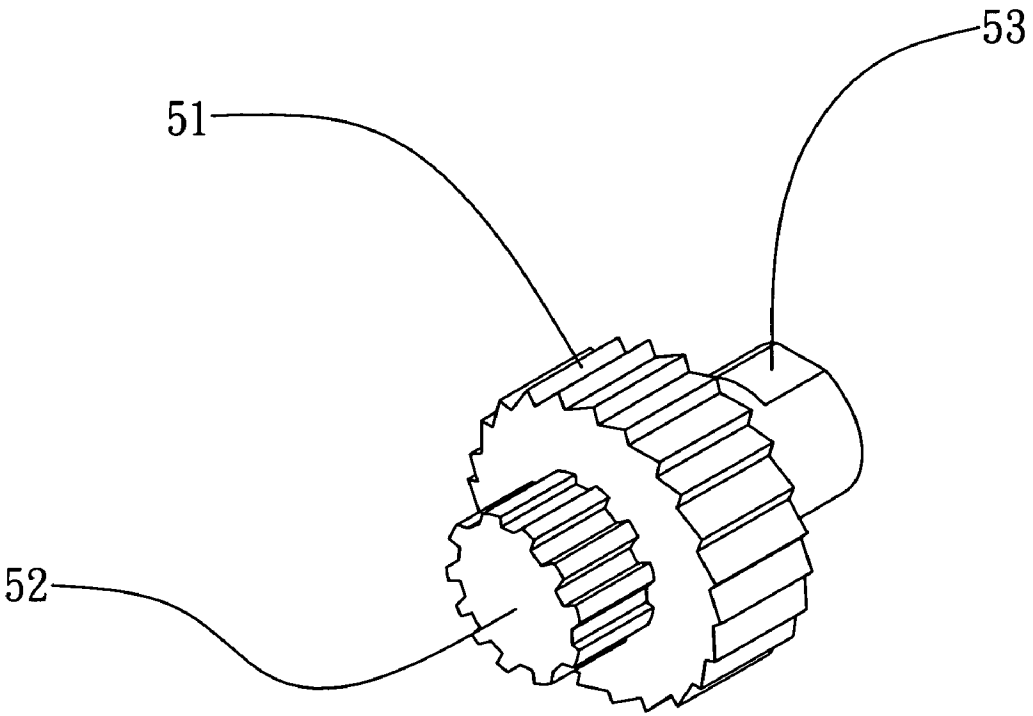
FIG. 3 is a perspective view of a drive member of the shoelace reel as shown in FIG. 2.
Figure 4:
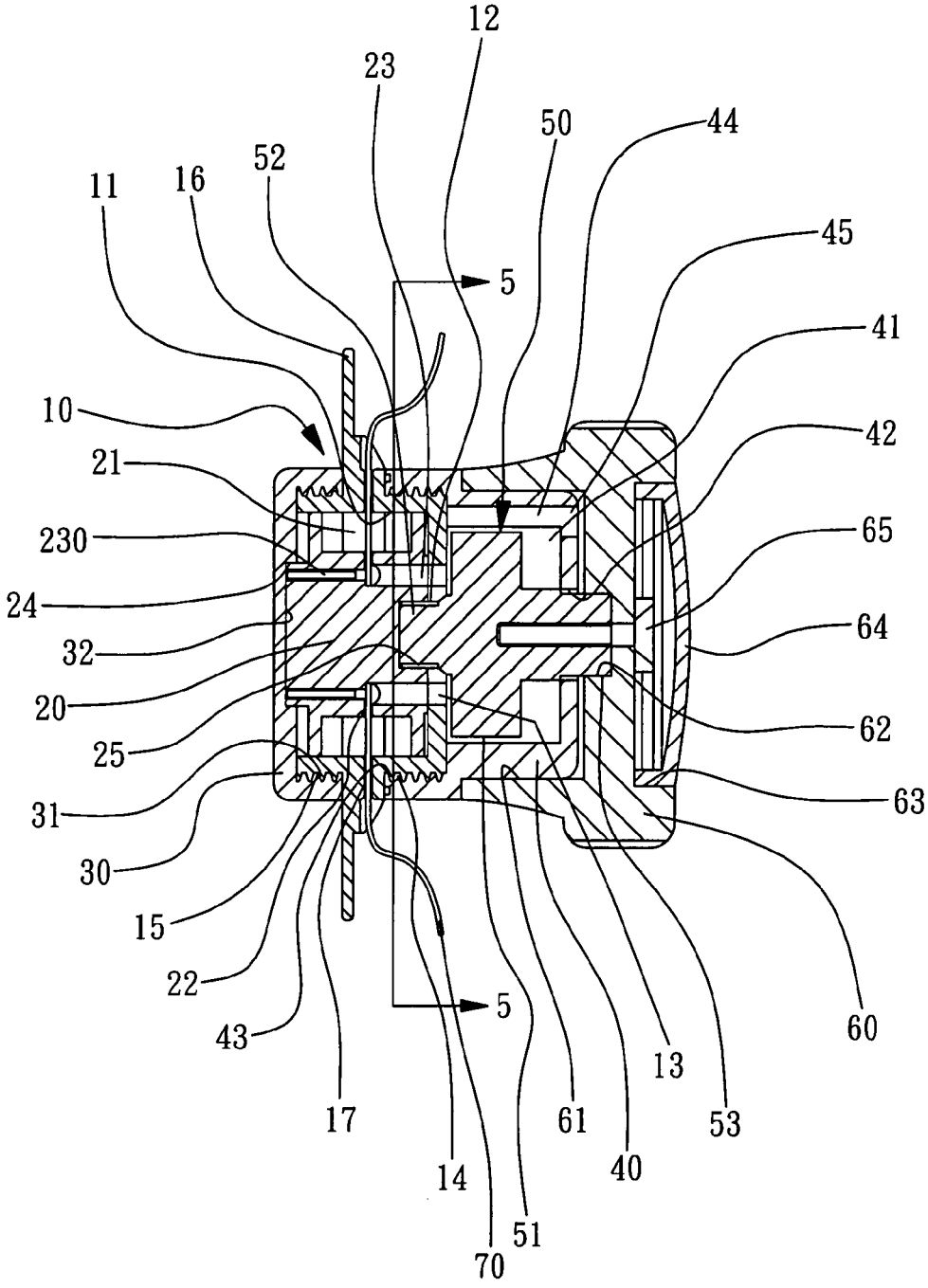
FIG. 4 is a cross-sectional view of the shoelace reel as shown in FIG. 1.
Figure 5:
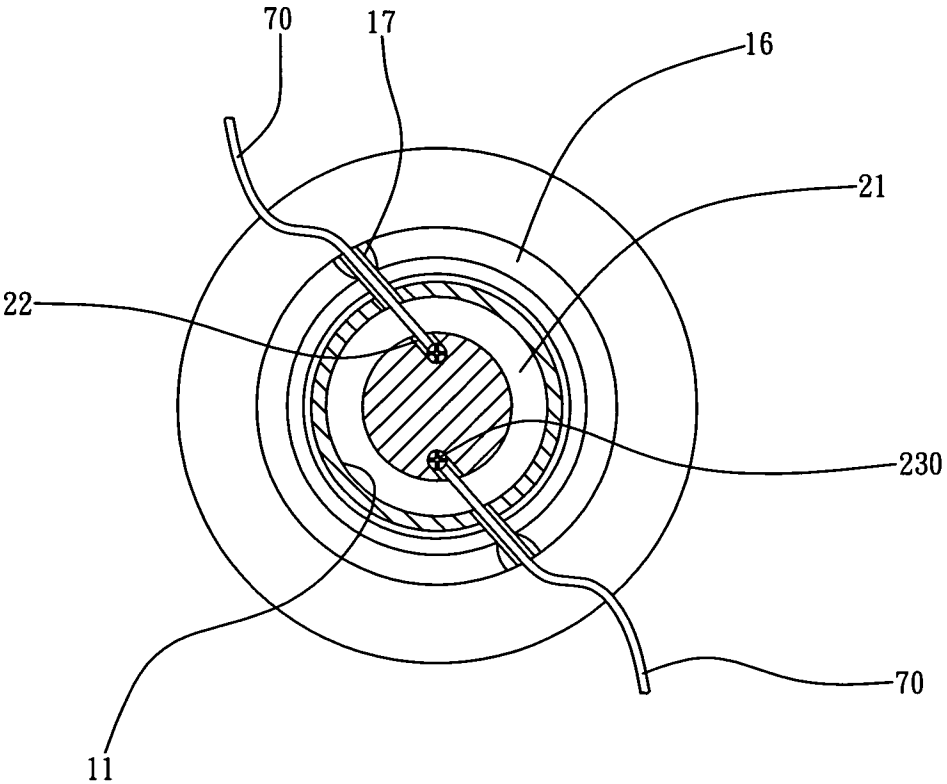
FIG. 5 is a cross-sectional view of the shoelace reel taken along line 5-5 as shown in FIG. 4.
Figure 6:
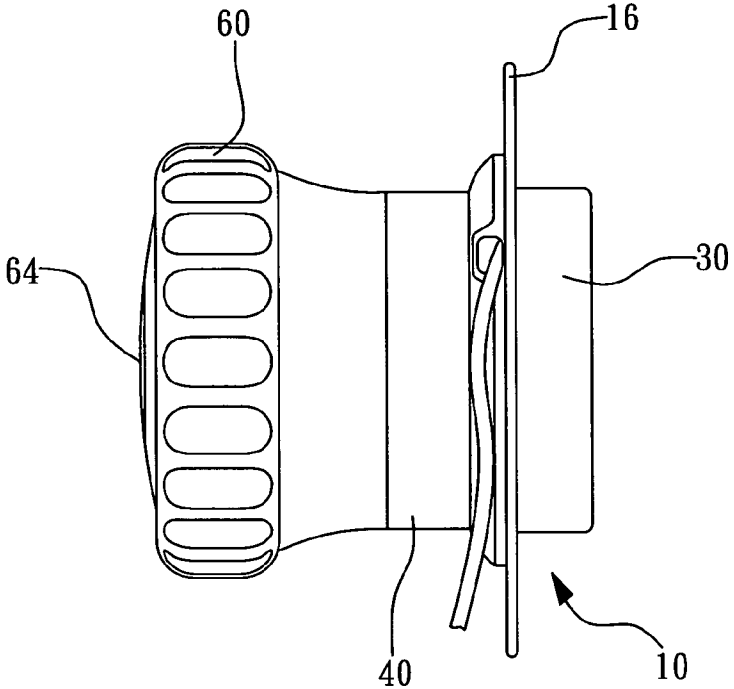
FIG. 6 is another side view of the shoelace reel as shown in FIG. 1.
Figure 7:
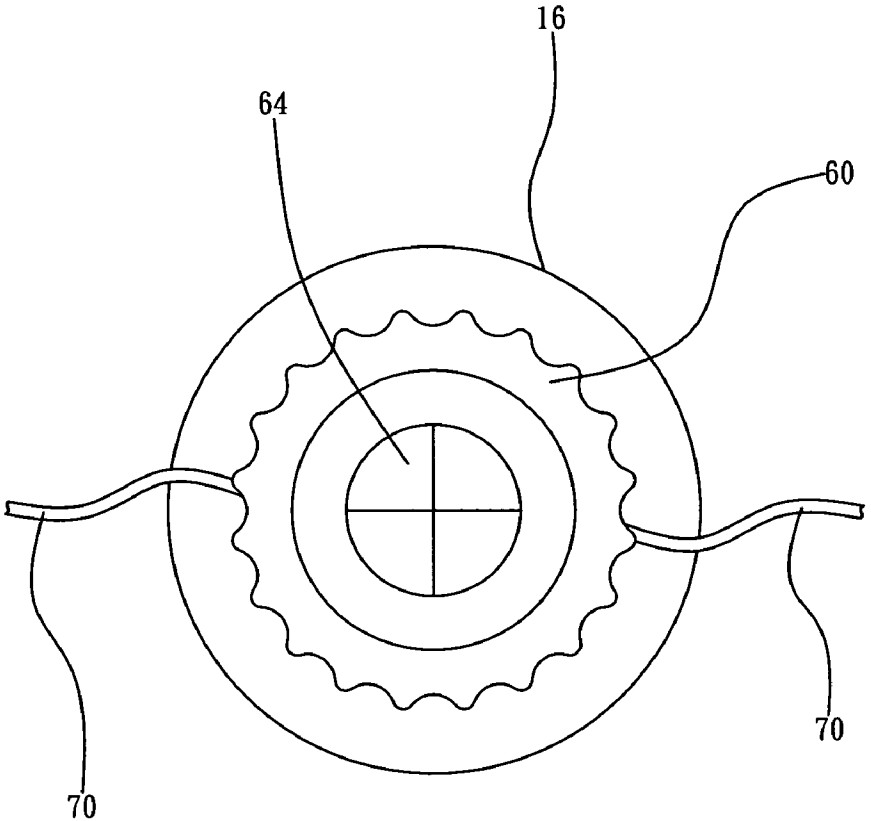
FIG. 7 is a front view of the shoelace reel as shown in FIG. 1.
Figure 8:
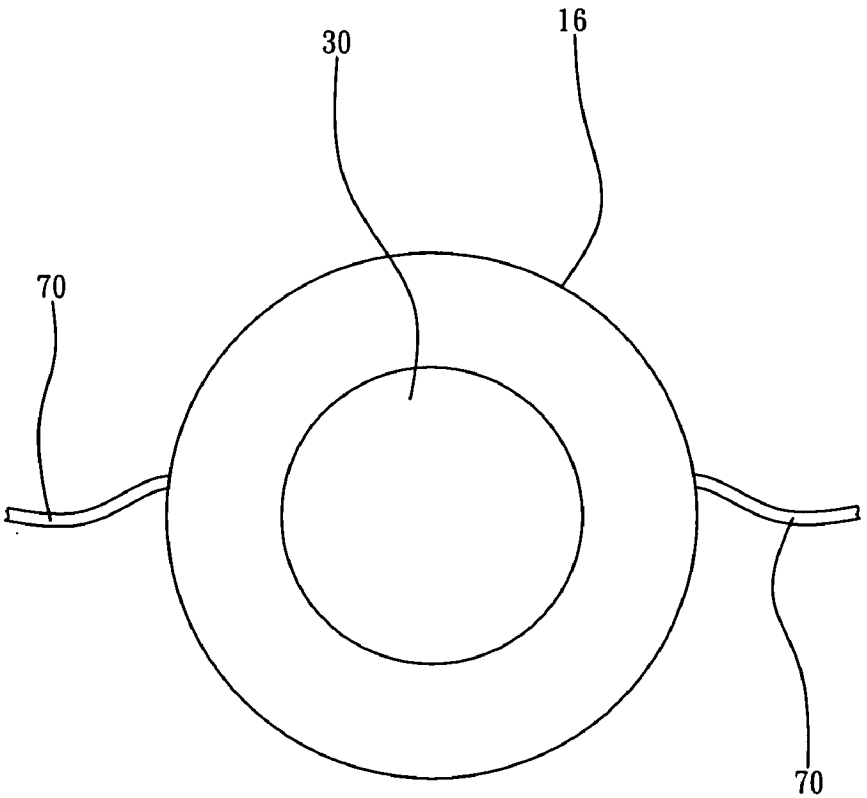
FIG. 8 is a rear view of the shoelace reel as shown in FIG. 1.

Referring to the drawings and initially to FIGS. 1-9, a shoelace reel in accordance with the preferred embodiment of the present invention comprises a support seat 10 having a first side formed with an axially extending receiving hole 11 and a periphery formed with two spaced guide holes 17 each connected to the receiving hole 11, a spool 20 rotatably mounted in the receiving hole 11 of the support seat 10 and having a periphery formed with a winding zone 21 and a first end formed with an inner gear 25, a shoelace 70 having two distal ends each extended through a respective guide hole 17 into the receiving hole 11 of the support seat 10 and each secured to the winding zone 21 of the spool 20 to move with the winding zone 21 of the spool 20, a limit sleeve 40 mounted on a second side of the support seat 10 and having an inner wall formed with an axially extending limit hole 41 and a plurality of oneway ratchet teeth 44, and a drive member 50 rotatably and movably mounted in the limit hole 41 of the limit sleeve 40 and having a first end formed with an outer gear 52 detachably meshing with the inner gear 25 of the spool 20 to rotate the spool 20, a mediate portion formed with a ratchet wheel 51 meshing with the oneway ratchet teeth 44 of the limit sleeve 40 and a second end formed with a drive shaft 53 protruded from the limit sleeve 40.

The support seat 10 has a mediate portion formed with a protruding positioning ring 16 which defines the guide holes 17. The first side of the support seat 10 has a periphery formed with a threaded portion 15. The second side of the support seat 10 has a periphery formed with a threaded section 14 and has an end face formed with a passage 12 and two conduits 13. The passage 12 of the support seat 10 has a diameter smaller than that of the receiving hole 11 to stop the spool 20 and is connected to the inner gear 25 of the spool 20 to allow passage of the outer gear 52 of the drive member 50.

The spool 20 is formed with two axially extending stepped screw bores 23. The winding zone 21 of the spool 20 has a periphery formed with two binding holes 22 each connected to a respective screw bore 23, and each of the distal ends of the shoelace 70 is extended through a respective binding hole 22 of the winding zone 21 of the spool 20 into the respective screw bore 23 of the spool 20. The shoelace reel further comprises two screw members 230 each extended through a respective conduit 13 of the support seat 10 and each screwed into a respective screw bore 23 of the spool 20 to fix a respective distal end of the shoelace 70 in the spool 20.

An end cap 30 is mounted on the first side of the support seat 10 and rested on a second end of the spool 20 to stop the spool 20. The end cap 30 has an inner wall formed with an inner thread 31 screwed onto the threaded portion 15 of the support seat 10 and has an end face formed with a pivot hole 32, and the second end of the spool 20 is formed with a protruding post 24 pivotally mounted in the pivot hole 32 of the end cap 30.

The limit sleeve 40 has an end face formed with a through hole 42 connected to the limit hole 41 and having a diameter smaller than that of the limit hole 41 to stop the ratchet wheel 51 of the drive member 50 and to allow passage of the drive shaft 53 of the drive member 50. The end face of the limit sleeve 40 has a periphery formed with a plurality of forming flow channels 45 connected to the oneway ratchet teeth 44 to facilitate forming of the oneway ratchet teeth 44 in fabrication. The inner wall of the limit sleeve 40 is formed with an inner thread 43 screwed onto the threaded section 14 of the support seat 10.

The ratchet wheel 51 of the drive member 50 has a thickness smaller than a depth of the limit hole 41 of the limit sleeve 40 to allow movement of the drive member 50 in the limit hole 41 of the limit sleeve 40. The ratchet wheel 51 of the drive member 50 is axially movable relative to the oneway ratchet teeth 44 of the limit sleeve 40.

A control knob 60 is rotatably and movably mounted on the limit sleeve 40 and connected to the drive shaft 53 of the drive member 50 by a locking member 65 so that the drive shaft 53 of the drive member 50 is driven by the control knob 60. The control knob 60 has a first side formed with a receiving chamber 61 to receive the limit sleeve 40 and a second side formed with a receiving recess 63 to receive a decorative cap 64 which covers the locking member 65. The receiving chamber 61 of the control knob 60 has a bottom wall formed with a fixing recess 62 to fix the drive shaft 53 of the drive member 50.

In assembly, referring to FIGS. 10-13 with reference to FIGS. 1-9, the support seat 10 is attached to a shoe tongue 72. Then, each of the distal ends of the shoelace 70 is extended through a respective guide hole 17 of the support seat 10, the receiving hole 11 of the support seat 10 and a respective binding hole 22 of the winding zone 21 of the spool 20 into the respective screw bore 23 of the spool 20. Then, each of the screw members 230 is extended through a respective conduit 13 of the support seat 10 and screwed into a respective screw bore 23 of the spool 20 to fix a respective distal end of the shoelace 70 in the spool 20. Then, the control knob 60 is mounted on the limit sleeve 40 and connected to the drive shaft 53 of the drive member 50 by the locking member 65.

In operation, the control knob 60 is rotatable on the limit sleeve 40 to rotate the drive member 50 which rotates the spool 20 to wind the distal ends of the shoelace 70 around the winding zone 21 of the spool 20 so as to tighten the shoelace 70 by successive rotation of the drive member 50 and the control knob 60. At this time, the ratchet wheel 51 of the drive member 50 is limited by the oneway ratchet teeth 44 of the limit sleeve 40 so that the drive member 50 is rotatable in a oneway manner to prevent the drive member 50 from being rotated in the reverse direction and to prevent the shoelace 70 from being loosened.

Figure 9:
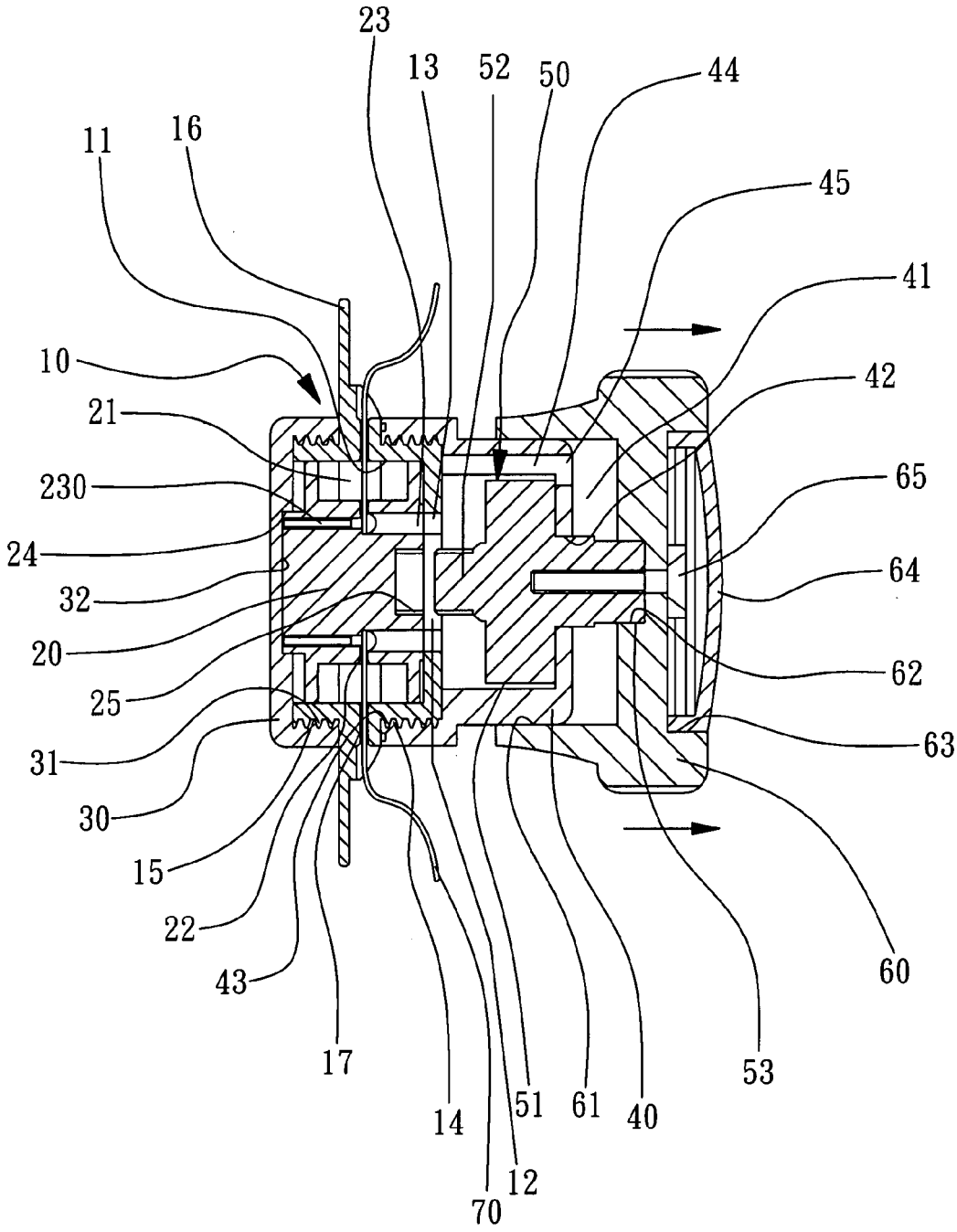
FIG. 9 is a schematic operational view of the shoelace reel as shown in FIG. 4.
Figure 10:
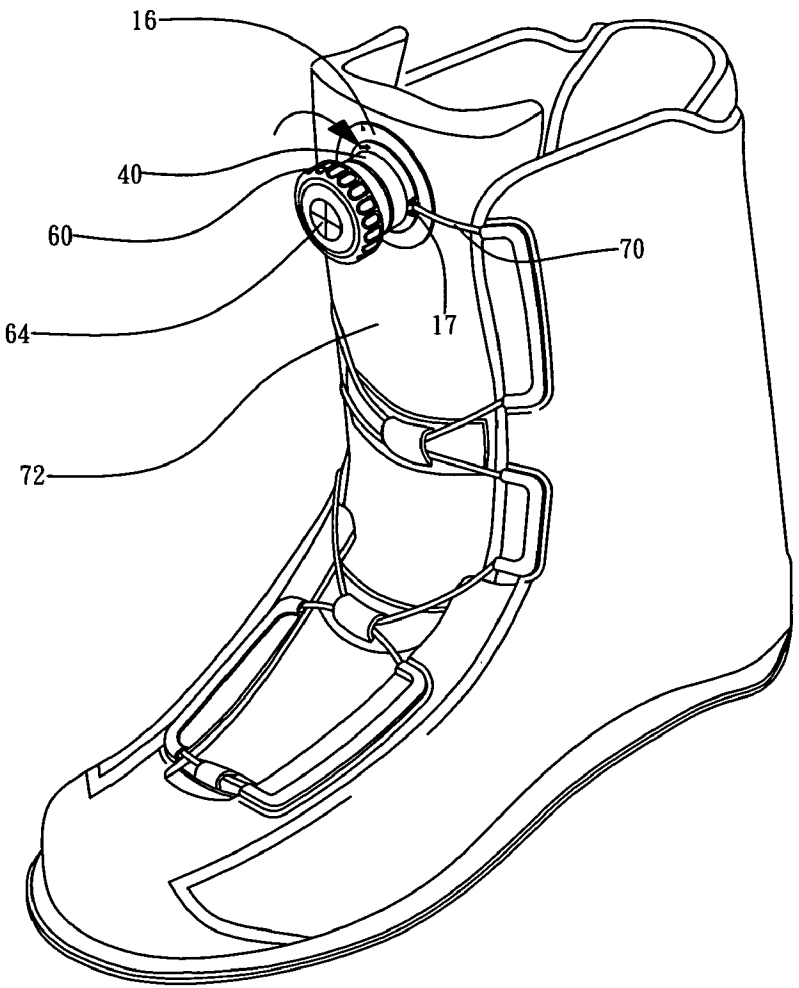
FIG. 10 is a perspective view showing usage of the shoelace reel as shown in FIG. 1.
Figure 11:
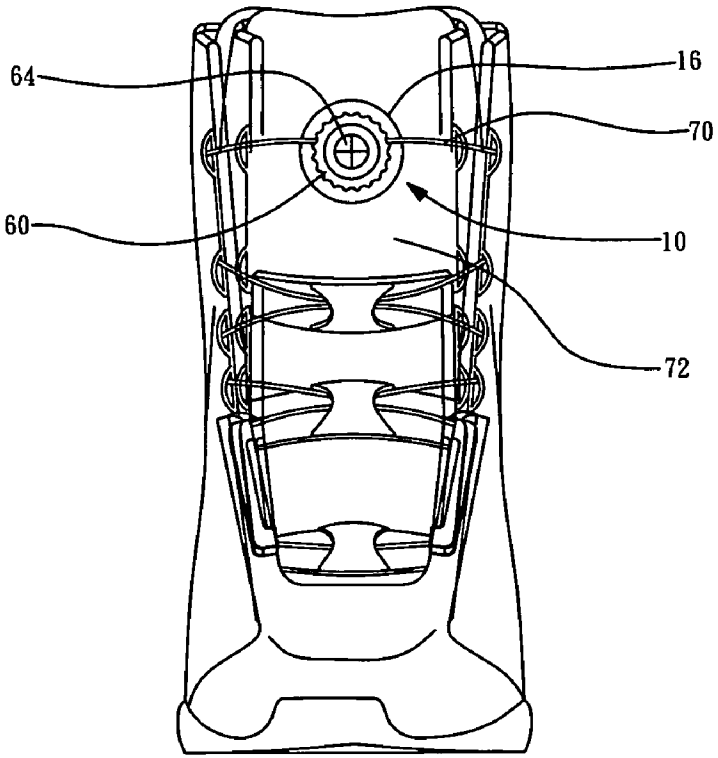
FIG. 11 is a front view of the shoelace reel as shown in FIG. 10.
Figure 12:
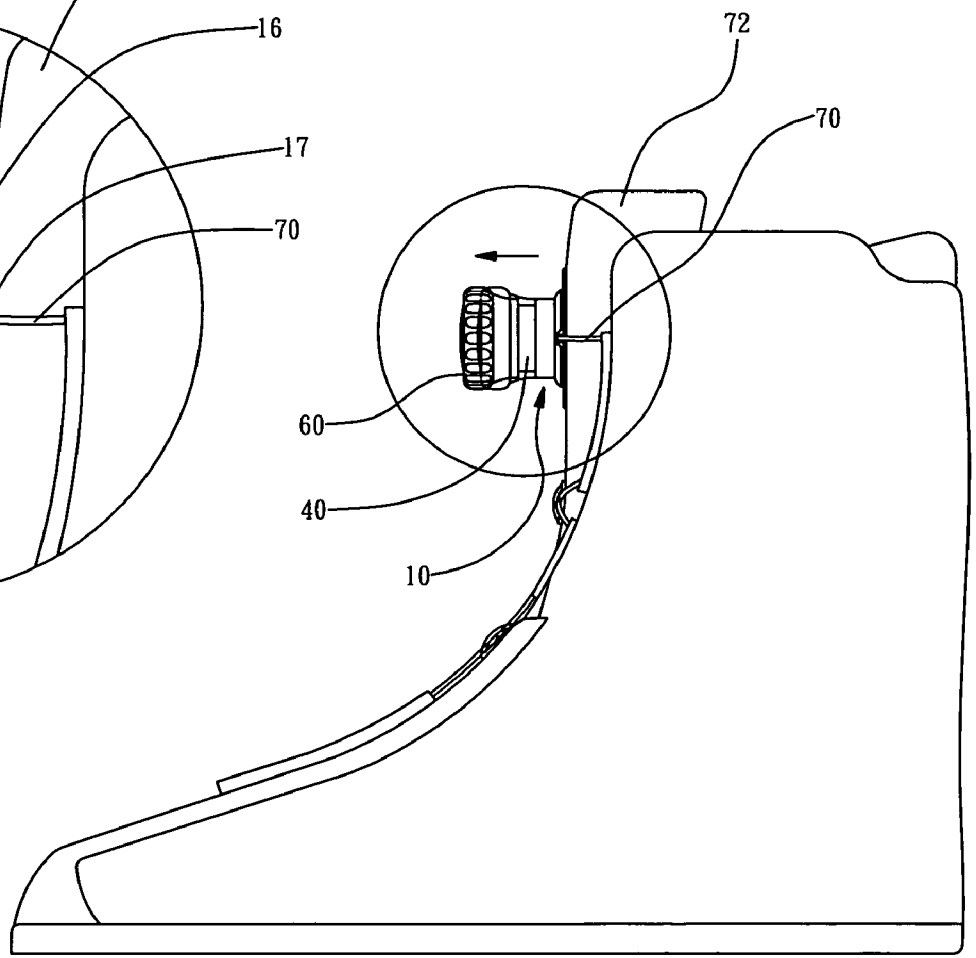
FIG. 12 is a side operational view of the shoelace reel as shown in FIG. 10.
Figure 13:
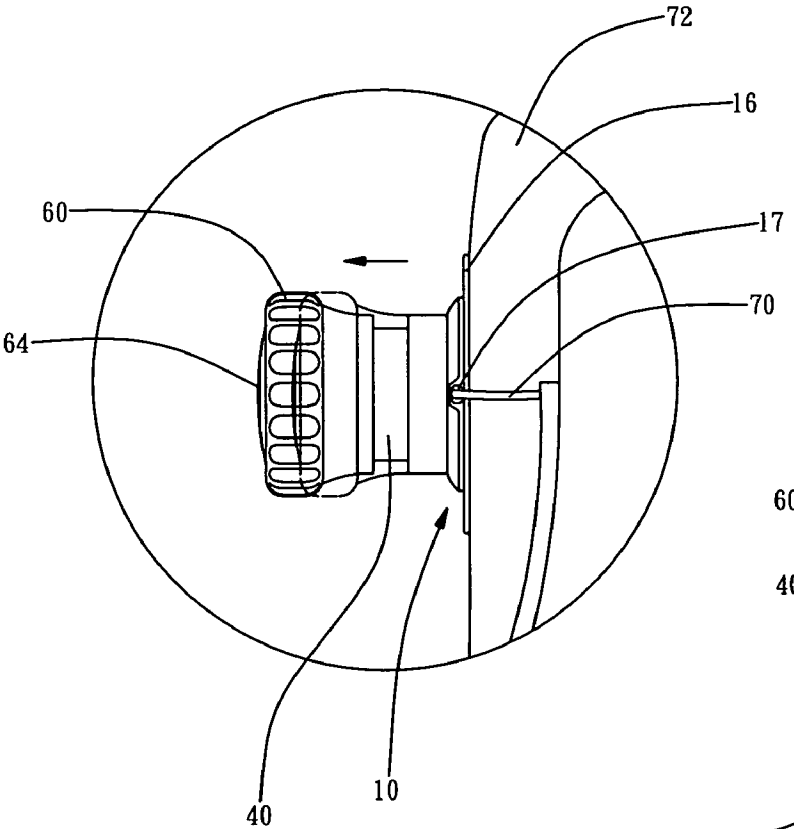
FIG. 13 is a locally enlarged view of the shoelace reel as shown in FIG. 12.

On the contrary, when the user wishes to loosen the shoelace 70, the control knob 60 is movable outwardly relative to the support seat 10 as shown in FIG. 12 to move the drive member 50 outwardly relative to the spool 20 to detach the outer gear 52 of the drive member 50 from the inner gear 25 of the spool 20 as shown in FIG. 9 to unlock the inner gear 25 of the spool 20 from the drive member 50 so that the spool 20 is rotatable freely to unwind the distal ends of the shoelace 70 from the winding zone 21 of the spool 20 so as to loosen the shoelace 70 by pulling the shoelace 70 successively.

Accordingly, the user only needs to rotate the control knob 60 to tighten the shoelace 70 and to pull out the control knob 60 to loosen the shoelace 70, so that the shoelace 70 is tightened and loosened easily and quickly. In addition, the user only needs to operate the control knob 60 to tighten or loosen the shoelace 70, so that the user can tighten or loosen the shoelace 70 by his one hand only, thereby facilitating the user tightening or loosening the shoelace 70. Further, the ratchet wheel 51 of the drive member 50 is limited by the oneway ratchet teeth 44 of the limit sleeve 40 so that the drive member 50 is rotatable in a oneway manner to prevent the drive member 50 from being rotated in the reverse direction and to prevent the shoelace 70 from being loosened. Further, the shoelace 70 is wound around and hidden in the winding zone 21 of the spool 20 to prevent the shoelace 70 from being worn out due to friction, thereby enhancing the lifetime of the shoelace 70.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A shoelace reel, comprising:

a support seat having a first side formed with an axially extending receiving hole and a periphery formed with two spaced guide holes each connected to the receiving hole;

a spool rotatably mounted in the receiving hole of the support seat and having a periphery formed with a winding zone and a first end formed with an inner gear;

a shoelace having two distal ends each extended through a respective guide hole into the receiving hole of the support seat and each secured to the winding zone of the spool to move with the winding zone of the spool;

a limit sleeve mounted on a second side of the support seat and having an inner wall formed with an axially extending limit hole and a plurality of oneway ratchet teeth;

a drive member rotatably and movably mounted in the limit hole of the limit sleeve and having a first end formed with an outer gear detachably meshing with the inner gear of the spool to rotate the spool, a mediate portion formed with a ratchet wheel meshing with the oneway ratchet teeth of the limit sleeve and a second end formed with a drive shaft protruded from the limit sleeve.

2. The shoelace reel in accordance with claim 1, wherein the second side of the support seat has an end face formed with two conduits, the spool is formed with two axially extending stepped screw bores, the winding zone of the spool has a periphery formed with two binding holes each connected to a respective screw bore, each of the distal ends of the shoelace is extended through a respective binding hole of the winding zone of the spool into the respective screw bore of the spool, and the shoelace reel further comprises two screw members each extended through a respective conduit of the support seat and each screwed into a respective screw bore of the spool to fix a respective distal end of the shoelace in the spool.

3. The shoelace reel in accordance with claim 1, further comprising an end cap mounted on the first side of the support seat and rested on a second end of the spool to stop the spool.

4. The shoelace reel in accordance with claim 1, further comprising a control knob rotatably and movably mounted on the limit sleeve and connected to the drive shaft of the drive member by a locking member so that the drive shaft of the drive member is driven by the control knob.

5. The shoelace reel in accordance with claim 1, wherein the support seat has a mediate portion formed with a protruding positioning ring which defines the guide holes.

6. The shoelace reel in accordance with claim 3, wherein the first side of the support seat has a periphery formed with a threaded portion, and the end cap has an inner wall formed with an inner thread screwed onto the threaded portion of the support seat.

7. The shoelace reel in accordance with claim 1, wherein the second side of the support seat has a periphery formed with a threaded section, and the inner wall of the limit sleeve is formed with an inner thread screwed onto the threaded section of the support seat.

8. The shoelace reel in accordance with claim 1, wherein the second side of the support seat has an end face formed with a passage connected to the inner gear of the spool to allow passage of the outer gear of the drive member.

9. The shoelace reel in accordance with claim 8, wherein the passage of the support seat has a diameter smaller than that of the receiving hole to stop the spool.

10. The shoelace reel in accordance with claim 3, wherein the end cap has an end face formed with a pivot hole, and the second end of the spool is formed with a protruding post pivotally mounted in the pivot hole of the end cap.

11. The shoelace reel in accordance with claim 1, wherein the limit sleeve has an end face formed with a through hole connected to the limit hole to allow passage of the drive shaft of the drive member.

12. The shoelace reel in accordance with claim 11, wherein the through hole of the limit sleeve has a diameter smaller than that of the limit hole to stop the ratchet wheel of the drive member.

13. The shoelace reel in accordance with claim 11, wherein the end face of the limit sleeve has a periphery formed with a plurality of forming flow channels connected to the oneway ratchet teeth to facilitate forming of the oneway ratchet teeth in fabrication.

14. The shoelace reel in accordance with claim 1, wherein the ratchet wheel of the drive member has a thickness smaller than a depth of the limit hole of the limit sleeve to allow movement of the drive member in the limit hole of the limit sleeve.

15. The shoelace reel in accordance with claim 1, wherein the ratchet wheel of the drive member is axially movable relative to the oneway ratchet teeth of the limit sleeve, and the ratchet wheel of the drive member is limited by the oneway ratchet teeth of the limit sleeve so that the drive member is rotatable in a oneway manner.

16. The shoelace reel in accordance with claim 4, wherein the control knob has a first side formed with a receiving chamber to receive the limit sleeve.

17. The shoelace reel in accordance with claim 16, wherein the control knob has a second side formed with a receiving recess to receive a decorative cap which covers the locking member.

18. The shoelace reel in accordance with claim 16, wherein the receiving chamber of the control knob has a bottom wall formed with a fixing recess to fix the drive shaft of the drive member.

19. The shoelace reel in accordance with claim 4, wherein the control knob is rotatable on the limit sleeve to rotate the drive member which rotates the spool to wind the distal ends of the shoelace around the winding zone of the spool so as to tighten the shoelace by successive rotation of the drive member and the control knob.

20. The shoelace reel in accordance with claim 4, wherein the control knob is movable outwardly relative to the support seat to move the drive member outwardly relative to the spool to detach the outer gear of the drive member from the inner gear of the spool to unlock the inner gear of the spool from the drive member so that the spool is rotatable freely.

* * * * *